US009193553B2

(12) United States Patent
Haberstroh

(10) Patent No.: US 9,193,553 B2
(45) Date of Patent: Nov. 24, 2015

(54) STACKER WHEEL FOR STACKING SHEETS

(71) Applicant: GIESECKE & DEVRIENT GMBH, Munich (DE)

(72) Inventor: Markus Haberstroh, Landsberg (DE)

(73) Assignee: Giesecke & Devrient GMBH, Munich (DE)

( * ) Notice: Subject to any disclaimer, the term of this patent is extended or adjusted under 35 U.S.C. 154(b) by 0 days.

(21) Appl. No.: 14/394,791

(22) PCT Filed: Apr. 15, 2013

(86) PCT No.: PCT/EP2013/001107
§ 371 (c)(1),
(2) Date: Oct. 16, 2014

(87) PCT Pub. No.: WO2013/156137
PCT Pub. Date: Oct. 24, 2013

(65) Prior Publication Data

US 2015/0061221 A1 Mar. 5, 2015

(30) Foreign Application Priority Data

Apr. 16, 2012 (DE) ..... 10 2012 008 475

(51) Int. Cl.

| | |
|---|---|
| ***B65H 29/20*** | (2006.01) |
| ***B65H 29/40*** | (2006.01) |
| ***B65H 29/68*** | (2006.01) |
| ***B65H 29/22*** | (2006.01) |
| ***B65H 29/54*** | (2006.01) |
| *B65H 39/065* | (2006.01) |
| *B65H 39/105* | (2006.01) |

(52) U.S. Cl.

CPC ..... *B65H 29/40* (2013.01); *B65H 29/22* (2013.01); *B65H 29/54* (2013.01); *B65H 29/68* (2013.01); *B65H 39/065* (2013.01); *B65H 39/105* (2013.01); *B65H 2301/5122* (2013.01); *B65H 2404/6582* (2013.01); *B65H 2404/661* (2013.01); *B65H 2701/1912* (2013.01)
(Continued)

(58) Field of Classification Search

CPC .. B65H 39/065; B65H 29/006; B65H 39/105; B65H 2404/661; B65H 2404/6582
USPC ..... 271/209, 187, 315
See application file for complete search history.

(56) References Cited

U.S. PATENT DOCUMENTS 4,522,387 A 6/1985 Leuthold
(Continued)

FOREIGN PATENT DOCUMENTS

DE 3232348 A1 3/1984
DE 10110103 A1 9/2002
(Continued)

OTHER PUBLICATIONS

German Search Report for corresponding German Application No. 102012008475.7, May 15, 2012.
(Continued)

*Primary Examiner* — Howard Sanders
(74) *Attorney, Agent, or Firm* — Workman Nydegger

(57) ABSTRACT

The stacking wheel has one or a plurality of first and second stacking-wheel disks which are disposed on an axle in a mutually concentric relationship and spaced apart in the axial direction. Distributed over their circumference, the stacking-wheel disks respectively have a plurality of sheet slots for receiving a sheet and are disposed in a mutually staggered relationship in a portion of the sheet slots. An azimuthal profile offset of the stacking-wheel disks has the effect that the sheet slots of the first stacking-wheel disk run ahead of or run behind the sheet slots of the second stacking-wheel disk. The sheet slots of the first and second stacking-wheel disks have at their radially inside end an azimuthal profile offset that is reduced or eliminated again up to the slot end of the sheet slots. This avoids damage to the stacked sheets.

15 Claims, 4 Drawing Sheets

(56) References Cited

U.S. PATENT DOCUMENTS

| | | | | |
|---|---|---|---|---|
| 4,925,179 | A | 5/1990 | Breton et al. | |
| 5,180,160 | A * | 1/1993 | Belanger | B65H 29/40 271/187 |
| 5,730,435 | A | 3/1998 | Belanger et al. | |
| 7,624,983 | B2 | 12/2009 | Hausler | |
| 2008/0185777 | A1 | 8/2008 | Hausler | |

FOREIGN PATENT DOCUMENTS

| | | | |
|---|---|---|---|
| DE | 102004023312 | A1 | 12/2005 |
| EP | 0842884 | A2 | 5/1998 |

OTHER PUBLICATIONS

International Search Report for corresponding International PCT Application No. PCT/EP2013/001107, Jul. 24, 2013.

* cited by examiner

STACKER WHEEL FOR STACKING SHEETS

BACKGROUND

This invention relates to a stacking wheel for stacking sheets and to a sheet-goods processing apparatus comprising such a stacking wheel, in particular for processing value documents.

Stacking wheels of the above-mentioned kind possess sheet slots distributed over the circumference for receiving sheets of the sheet goods to be stacked. The sheet slots extend along a substantially spiral-shaped course from radially outward to radially inward within the stacking wheel. Hence, sheet-goods processing apparatuses equipped with such stacking wheels are also designated spiral slot stackers.

Automatic sorting machines in which sheet-shaped articles are sorted are to be able to process maximum numbers of pieces within a minimum time, which necessarily leads to high transport speeds. In conventional spiral slot stackers it is problematic to increase the transport speed to more than 40 sheets per second, since the sheets running into the stacking wheel must be decelerated to a standstill on a short path within a short time. In particular, the sheets can thereby hit the end of the sheet slots and consequently be damaged at the leading sheet edges.

DE 3232348 A1 describes a spiral slot stacker that has a plurality of stacking-wheel disks rotating around a common axle and having sheet slots extending from the outside to the inside in a spiral shape. The sheet slots of the disks each form a delivery slot into which a sheet is inserted tangentially. Using a stripper disposed between the disks the sheets are stripped out of the delivery slots. The circumferential speed of the disks is substantially lower than the transport speed of the sheets, so that the sheet running in slides with its surface frictionally along the outer boundary walls of the spiral-shaped sheet slots. The frictional force resulting from the relative motion decelerates the sheet. To increase the friction for decelerating the sheets running into the stacking wheel, it is proposed in DE 3232348 A1 to mutually "stagger" the spiral-shaped sheet slots of the stacking-wheel disks disposed side by side on the common axle. Staggering is to be understood to mean that the spirally extending sheet slots are not mutually congruent when viewed along the drive axle, but extend differently. The sheets running into the sheet slots thereby become wavy in a direction transverse to the moving direction of the sheets. This can be obtained e.g. with identical stacking-wheel disks whose sheet slots all have the same spiral curvature when at least one of the stacking-wheel disks is mounted on the drive axle so as to be rotated by a small angular amount relative to the other stacking-wheel disks. Due to the wavy curvature imposed on the sheets when the sheets are moved along the sheet slots, the pressure of the sheets against the boundary walls of the spiral slots is increased, so that frictional forces and thus the braking action increase accordingly. Upon a further increase of the transport speed of the sheets to be stacked, however, the stacked sheets show damage to the leading sheet edges.

SUMMARY

To avoid damage to the leading edges, there have hence been many attempts to increase the braking action. For stronger deceleration of the sheets there can be employed stacking wheels with a greater diameter and thus a longer braking distance. However, this is disadvantageous due to the increased space requirement. A greater frictional force and thus a stronger deceleration is also possible by reducing the slot width of the sheet slots. However, a strongly reduced slot width can lead to problems when the sheets are stripped from the stacking wheel. Sometimes separate brake blocks are also employed which are disposed meshingly with the stacking wheels in order to form an additional brake area for the sheets running in. This manner of deceleration requires additional components, thereby increasing the manufacturing and servicing effort. Hitherto the sheet slots have also been equipped with elastic brake guides which are urged away by the sheets running into the sheet slot, thereby braking said sheets more strongly.

The object of the present invention is to state a stacking wheel for stacking sheets with which damage to the stacked sheets is avoided even at high transport speeds of the sheets to be stacked.

The stacking wheel has one or a plurality of first, and one or a plurality of second, stacking-wheel disks which are disposed on an axle in a mutually concentric relationship and which are spaced apart in the axial direction. Distributed over their circumference, the stacking-wheel disks respectively have a plurality of sheet slots for receiving a sheet of the sheet goods. The sheet slots extend from radially outward to radially inward in a spiral shape within the respective stacking-wheel disk. Mutually corresponding sheet slots of the first and of the second stacking-wheel disks, which are disposed one behind the other when viewed along the axle, respectively form a receiving slot for the sheets. For stacking the sheets, the stacking wheel rotates around its axle. For stripping the sheets from the sheet slots of the stacking wheel there is employed a stripper which strips the sheets from the sheet slots upon rotation of the stacking wheel. The stripper is so disposed on the stacking wheel and so configured that it is not employed for decelerating the sheet goods, but only for stripping the sheet goods from the stacking wheel. The stripper thus only contacts the sheet after the sheet has come to a standstill relative to the stacking wheel. This avoids an acceleration of the sheet through the stripper, contrary to the moving direction of the sheet.

The sheet slots of the first and second stacking-wheel disks are disposed in a mutually staggered relationship in a staggered portion of the sheet slots. In this staggered portion the sheet slots of the first and second stacking-wheel disks have an azimuthal profile offset. The azimuthal profile offset is the mutual distance in the azimuthal direction between two mutually corresponding (e.g. the two lower or the two upper) sheet-slot boundaries of the different stacking-wheel disks. This azimuthal profile offset has the effect, when the stacking apparatus rotates around the axle for stacking sheet goods, that the sheet slots of the first stacking-wheel disks run ahead of or run behind the sheet slots of the second stacking-wheel disks. The sheet slots of the first and second stacking-wheel disks are disposed in a mutually staggered relationship in the staggered portion such that there is imposed on the sheets received into the sheet slots a wavy deformation in a direction transverse to the moving direction of the sheets. By wavy deformation an effective deceleration of the sheets is obtained with little technical effort.

In contrast to hitherto known stacking wheels, in the stacking wheel according to the invention the azimuthal profile offset that the sheet slots of the stacking-wheel disks have in the staggered portion is reduced or eliminated again up to the slot end of the sheet slots, viewed along the sheet slot from radially outward to radially inward. The leading edges of the sheets transported into the sheet slots are hence wavily deformed transversely to the moving direction of the sheets in the staggered portion and stretched again in an end portion of the sheet slots. In the end portion the sheet slots of the first and second stacking-wheel disks have no or such a small azimuthal profile offset relative to each other that the leading edges of the sheets no longer have any wavy deformation transverse to the moving direction of the sheets when hitting the slot end. For example, the leading edge of the respective sheet forms substantially a straight line when said edge hits the slot end of the sheet slot. The end portion can be a congruent portion in which the sheet slots of the second stacking-wheel disks extend congruently to the sheet slots of the first stacking-wheel disks. The end portion can, however, also be so configured that the sheet slots of the second stacking-wheel disks extend in a slightly staggered mutual relationship relative to the sheet slots of the first stacking-wheel disks. For it has turned out that this reduces the braking force acting on the sheets at the inner slot end, in comparison to a greatly staggered slot end. The lower braking force acting on the sheets at the inner slot end facilitates the stripping of the sheets, since the stripping force required for stripping the sheets from the sheet slots is reduced. This avoids damage to the leading edges of the sheet goods upon stripping.

In dependence on the condition of the sheets and in dependence on the transport speed of the sheets, some sheets are already decelerated to a standstill before the slot end. Those sheets that are not already decelerated to a complete standstill before the slot end have a residual speed an the slot end and are consequently only decelerated from the residual speed to a final standstill by the slot end. With a greatly staggered portion at the slot end, it has been observed that some sheets that undergo a greater brake effect due to their condition and hence already come to a standstill before reaching the slot end are damaged upon stripping, because the onset of stripping is delayed by their standstill before reaching the slot end. Through the lower braking action in the radially inside end portion of the sheet slots and at the slot end it is achieved that such sheets also reliably reach the slot end and only come to a standstill there, and not already before the slot end. Thus it can be ensured for virtually all sheets—regardless of their condition—that they hit the stripper at the intended time with their leading sheet edge to be pushed out. Since the stripping force then acts for a sufficiently long time period, damage to the leading sheet edges upon stripping can be avoided.

In the case of very high transport speeds, with sheets that are decelerated from the residual speed to a final standstill only by the slot end, the leading edge can also be damaged when the sheets are being decelerated. It has been found that, with hitherto known mutually staggered sheet slots, the sheets first hit the slot ends of the trailing stacking-wheel disks and are only decelerated by the latter, but only hit the slot ends of the running-ahead stacking-wheel disks shortly thereafter or not at all. In the stacking wheel according to the invention, the sheet slots of the first stacking-wheel disk and the sheet slots of the second stacking-wheel disk are hence preferably disposed relative to each other in the end portion of the sheet slots such that the sheets reach the slot end of the first and second stacker disks simultaneously. Thus, the deceleration of the sheets to a standstill is effected at a plurality of slot ends simultaneously. Since the braking force is distributed over a plurality of impact points per sheet, local damage to the sheets at the impact points can be avoided.

The sheet-slot end portion lying at the radially inside slot end is e.g. so chosen in its length that no wavy deformation is imposed on the sheets at the slot end any longer, but rather the sheets reach the slot end in a condition in which at least the leading edge and the adjacent sheet margin have no wavy shape transverse to the moving direction of the sheet, but lie in a plane. The braking force acting at the slot end is thereby reduced even further.

The sheet slots of the first and second stacking-wheel disks preferably have at least at the respective slot end, preferably in the total end portion, no or an azimuthal profile offset relative to each other that is smaller than the width of the sheet slots of the first and second stacking-wheel disks that the respective sheet slot has at the respective position along the sheet slot. In particular, the sheet slots of the first and second stacking-wheel disks have at the respective slot end at most an azimuthal profile offset of 80% of the sheet-slot width, in particular at most 0.4 mm. For example, the azimuthal profile offset of the sheet slots of the first and second stacking-wheel disks is lower than the width of the sheet slots as of a position of e.g. at least 5 mm before the respective slot end, preferably at least 10 mm before the respective slot end.

Preferably, the azimuthal profile offset, at every position of the sheet slots, i.e. also at every position in the staggered portion of the sheet slots, is smaller than 1.5 times the width of the first and of the second sheet slot that the respective sheet slot has at the respective position. This obtains a gentle deceleration of the sheet goods, since a low braking force acts on the sheets over a long braking distance. The sheets are thus worn to a lesser extent.

The staggered portion in which the sheet slots of the first and second stacking-wheel disks are disposed in a mutually staggered relationship preferably begins, viewed along the sheet slots of the first and second stacking-wheel disks from radially outward to radially inward, at a position that is removed from the outer end of the sheet slots by at least 90% of the length of the sheets to be stacked. Since the sheets have already run into the sheet slot almost completely before the strong braking action sets in, the sheets are transported safely into the sheet slot. For example, the sheet slots of the first and second stacking-wheel disks extend in mutually congruent relation in a first portion beginning at the outer end of the sheet slots, viewed along the sheet slots of the first and second stacking-wheel disks from radially outward to radially inward. This first portion preferably extends over a length of at least 90% of the sheet-goods length. The congruent first portion is followed by the staggered portion. Preferably, the azimuthal profile offset that the sheet slots of the first and second stacking-wheel disks have relative to each other is greater on an average in the first half of the staggered portion than in the second half of the staggered portion, viewed along the sheet slot from radially outward to radially inward. The azimuthal profile offset decreases consistently monotonically e.g. in the last 40 mm of the sheet slot up to the slot end, viewed along the sheet slot from radially outward to radially inward. It is thereby achieved that a lower braking force acts at the slot end.

In some exemplary embodiments, the sheet slots of the first and second stacking-wheel disks have a straight sheet-slot boundary in a first portion beginning at the outer end of the sheet slots of the first and second stacking-wheel disks, viewed from radially outward to radially inward. Such sheet slots of the first and second stacking-wheel disks preferably respectively have an opening angle of at least 25° between the boundaries of the respective sheet slot. This gives the outer sheet-slot ends an especially great width. The insertion time window for the sheets to be transported into the stacking wheel is thereby increased.

Through the staggering of two or more stacking-wheel disks there is obtained a wavy deformation of the sheets transverse to the moving direction of the sheet goods. Additionally, it is also possible that the sheet slots of the stacking wheel extend wavily, viewed from radially outward to radially inward along the respective sheet slot, i.e. along the moving direction of the sheets in the sheet slot. Such a longitudinal wavy shape of the sheet slots forces the sheet running into the stacking wheel to change from a first, positive curvature to the second, negative curvature in the further course of the sheet slot. In this manner the braking force on the sheet running into the stacking wheel can be increased in comparison to a stacking wheel whose spiral-shaped sheet slots are consistently curved positively. Furthermore, the length of the sheet-goods slots in the stacking wheel, and thus the available braking distance, is simultaneously increased at the same stacking-wheel diameter.

The sheet slots are adapted by their form, width, length and staggering to the transport speed and to the mechanical properties of the sheets such that the sheets running into the sheet slots are so decelerated in the sheet slots that their leading edges reach the radially inside slot end of the sheet slots. Preferably, the sheet slots are respectively so constituted that the sheet-slot width consistently decreases or at least remains the same, viewed from radially outward to radially inward, but increases at no point of the sheet slot, viewed from radially outward to radially inward. In particular, along the sheet slots there is no constriction at which the two surfaces of the respective sheet slot come mutually closer than at a position after this constriction, viewed along the sheet slot from radially outward to radially inward. This avoids damage to the sheets that can be caused by any constrictions of a sheet slot in sheets having a poor condition.

To further optimize the stacking of the sheets, the sheet slots of the stacking wheel, in particular the sheet-slot course, the sheet-slot width and the azimuthal profile offset, can be chosen differently in dependence on the sheet-goods quality or in dependence on the sheet-goods material (e.g. paper or plastic). For example, with used, limp sheets it is advantageous to employ a stacking wheel with a greater azimuthal profile offset of the sheet slots or with a smaller sheet-slot width than with stiff sheets, such as e.g. bank notes with a good condition of use or freshly printed bank notes, since the latter are already strongly braked with a low profile offset.

The braking action can be increased additionally when there are employed in a stacking wheel two or more stacking-wheel disks that are mounted on the same stacking-wheel axle, for example four, five or six stacking-wheel disks. The number of stacking-wheel disks mounted on an axle can be chosen, on the one hand, in dependence on the desired braking action and, on the other hand, in dependence on the width of the sheets to be stacked, more stacking-wheel disks with wider sheets and fewer stacking-wheel disks with narrower sheets.

The stacking wheel has e.g. at least two first stacking-wheel disks and at least two second stacking-wheel disks which are disposed on the axle in a mutually concentric relationship and which are respectively mutually offset along the axle. In particular, the stacking wheel has at least two disk pairs which are respectively formed by one of the first stacking-wheel disks and by one of the second stacking-wheel disks and which are disposed on the axle in a mutually concentric relationship and which are spaced apart in the axial direction. This achieves a pronounced wavy deformation transverse to the moving direction of the sheets and thus a higher braking action. Preferably, the two stacking-wheel disks of the respective disk pair are disposed along the axle e.g. at a distance apart of at most 15 mm, in particular at most 10 mm. These disk pairs consisting of closely-spaced disks disposed in a staggered relationship make it possible to attain an especially great braking action in the staggered portion. For example, the two disk pairs are disposed approximately symmetrically to the middle of the sheets. Viewed along the axle, there are disposed in the middle of the stacking wheel one or a plurality of second stacking-wheel disks whose sheet slots run ahead of the sheet slots of the first stacking-wheel disks, due to the staggering, when the stacking wheel rotates around the axle for stacking the sheets. On both sides of the second stacking-wheel disks disposed in the middle there is respectively disposed at least one first stacking-wheel disk.

The invention also relates to an apparatus for processing sheets which has at least one of the above-mentioned stacking wheels. The apparatus has e.g. a transport device through which the sheets are transported to the stacking wheel singly one after the other. The apparatus can be an apparatus for processing, in particular for checking and/or sorting, value documents, in particular bank notes. The stacking wheel according to the invention enables bank notes with the most varied quality, both limp and freshly printed bank notes, being transported at very high transport speed to be deposited into a uniform stack without damage.

BRIEF DESCRIPTION OF THE DRAWINGS

Hereinafter, the invention will be explained by way of example with reference to the following figures. There are shown.

DETAILED DESCRIPTION OF VARIOUS EMBODIMENTS

Figure 1A:
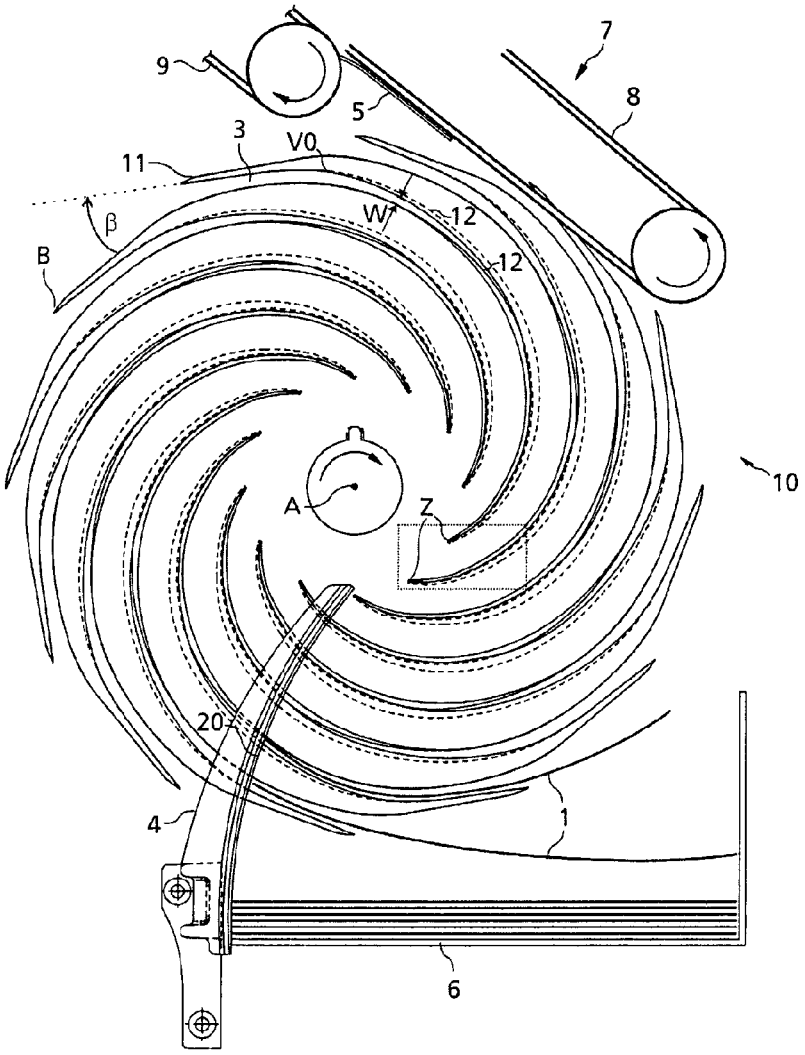
FIGS. 1*a-b* stacking wheel and detail of the stacking wheel at the sheet-slot end according to a first exemplary embodiment, FIG. 1*c* course of the azimuthal profile offset as a function of the position along a sheet slot, FIGS. 2*a-b* stacking wheel and detail of the stacking wheel at the sheet-slot end according to a second exemplary embodiment, FIGS. 3*a-e* sectional view through the sheet slots with a viewing direction contrary to the moving direction of the sheets, for different positions along a sheet slot, FIGS. 4*a-d* stacking wheel according to the prior art (FIG. 4*a*), detail of the stacking wheel from FIG. 4*a* at the sheet-slot end (FIG. 4*b*), plan view of the sheet-slot end along the direction 15 from FIG. 4*b* in the stacking wheel from FIG. 4*a* (FIG. 4*c*) and in a stacking wheel according to the invention (FIG. 4*d*).
Figure 2A:
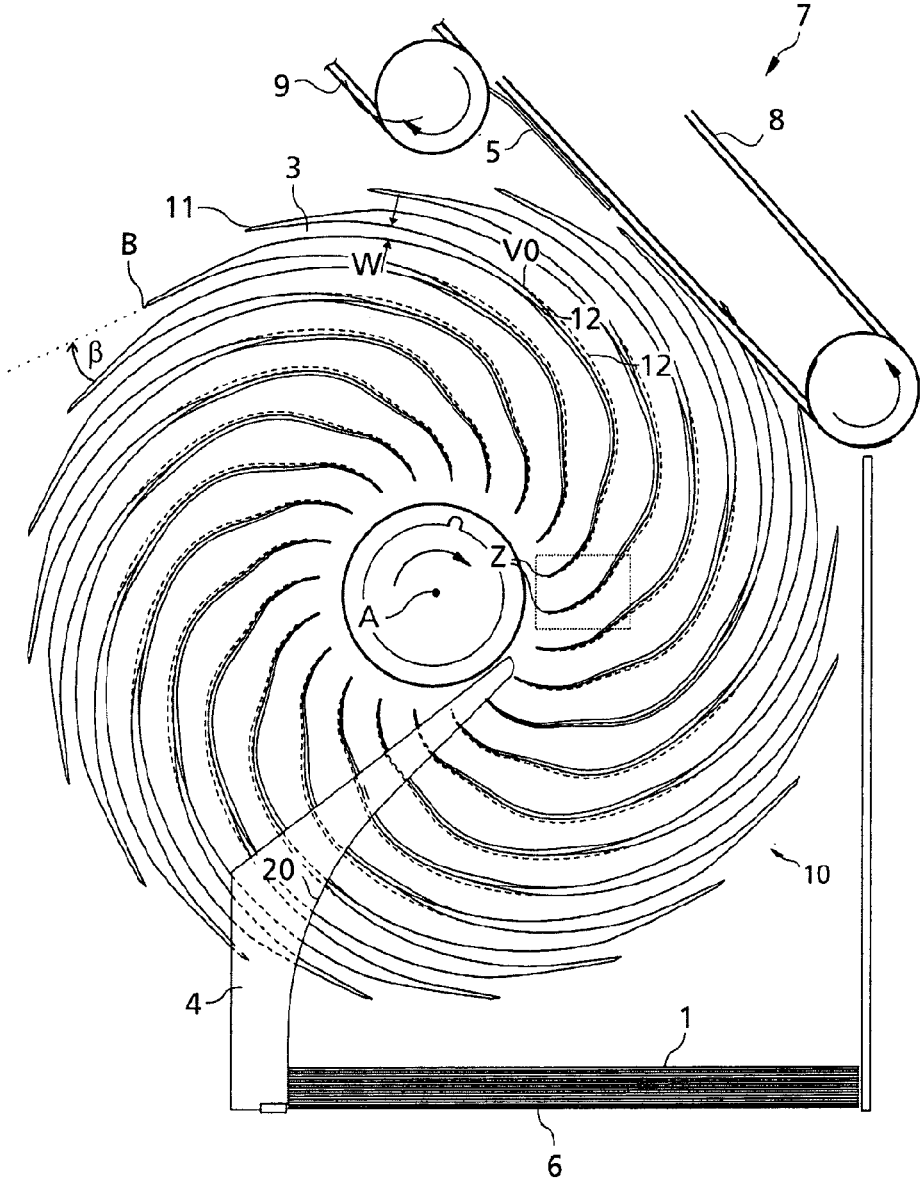

Hereinafter, reference will be made to bank notes to be stacked due to the preferred area of application, but without the invention being restricted to this application. FIGS. 1*a* and 2*a* respectively show a stacking wheel 10 contained in an apparatus for value-document processing, FIG. 1*a* according to a first exemplary embodiment and FIG. 2*a* according to a second exemplary embodiment. The stacking wheel 10 has distributed over its circumference a plurality of sheet slots 3 for respectively receiving a bank note. Above the stacking wheel 10 there is represented a transport device 7 of the value-document processing apparatus, which has two transport bands 8, 9 between which the bank notes to be stacked are fed to the rotating stacking wheel 10 successively at close spacing and at high speed. A guide plate 5 advances the delivered bank notes up to the entrance opening of a sheet slot located in the receiving position at the moment. The transport of the transport bands 8, 9 and the rotation of the stacking wheel 10 are mutually coordinated such that only exactly one bank note is always transported into a sheet slot and the next bank note into the next sheet slot. The interstices between the stacking-wheel disks are engaged, on the one hand, by belts of the upper transport band 8 and, on the other hand, by the stripper 4 which consists of a plurality of elements disposed side by side which respectively engage meshingly between two stacking wheels.

The stripper 4 strips the bank notes from the sheet slots 3 when the stacking wheel 10 rotates clockwise around the stacking-wheel axle A. For illustrating this operation, there are represented in the lower sheet slots of the stacking wheel 10 from FIG. 1*a* bank notes 1 that are being stripped and stacked on a deposit area 6. The form of the stripper 4 is adapted to the course of the sheet slots, in order that the sheets 1 lie against the stripper 4 with their edges if possible at a right angle or at a slightly obtuse angle upon stripping, if possible during the entire stripping operation, that is to say, at every angular position of the stacking wheel. Upon operation of the stacking wheel 10 the sheets 1 to be stripped from the sheet slots of the stacking wheel hit the stripper in a contact zone 20 of the stripper 4, said zone forming an angle between about 90° to 110° with the respective sheet slots at the impact point of the bank notes and during the stripping operation. The stated angle is—in terms of the respective sheet slot—the angle, facing the stacking-wheel axle A, that the sheet slot 3 encloses with the contact zone 20 of the stripper 4 during the stripping operation.

The width W of the sheet slots 3 tapers from radially outward to radially inward. At the radially outside beginning B the sheet slots possess e.g. a width in the range of 5 mm to 15 mm. The sheet slots 3 have there on both sides a straight sheet-slot boundary and an opening angle β of preferably at least 25°. The length of each sheet slot 3 begins at the beginning B and ends at the slot end Z of the sheet slot 3 near the stacking-wheel axle A.

The stacking wheels 10 from FIGS. 1*a* and 2*a* respectively have a plurality of stacking-wheel disks 11, 12 which are mounted side by side on the stacking-wheel axle A respectively at a space apart. Since the other stacking-wheel disks 11, 12 lie there behind, one can see in FIGS. 1*a* and 2*a* primarily the outside contour of the foremost first stacking-wheel disk 11. The other first stacking-wheel disk 11 lies congruently to the foremost one. The second stacking-wheel disks 12 different from the first stacking-wheel disk 11 are staggered relative to the first stacking-wheel disks 11 and accordingly have an azimuthal profile offset P relative to the first stacking-wheel disks 11. The second stacking-wheel disks 12 can be seen in FIGS. 1*a* and 2*a* only at that position at which they do not extend congruently with the first stacking-wheel disk 11. The second stacking-wheel disks 12 hence project partly between the sheet slots 3 of the first stacking-wheel disk 11 (continuous line 12). The outside contour of the stacking-wheel disks 12 that are hidden by the foremost stacking-wheel disk 11 is dashed in FIG. 1*a* and FIG. 2*a* (dashed line 12).

The stacking wheel 10 represented in FIG. 1*a* has sheet slots that have a spiral-shaped course with positive curvature consistently up to the slot end Z. In comparison thereto, the stacking wheel 10 represented in FIG. 2*a* has, superimposed on the spiral shape, a wavy sheet-slot course which imposed a wavy shape in the longitudinal direction on the bank notes transported into the sheet slots 3 in order to decelerate them more strongly.

Figure 1B:
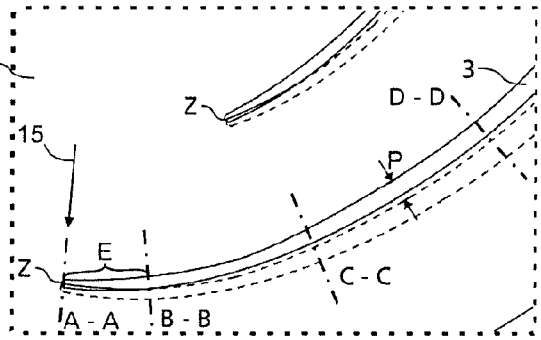

FIG. 1*b* shows an enlarged detail of the stacking wheel 10 of the first exemplary embodiment as represented in FIG. 1*a* (the detail being marked by dashed lines in FIG. 1*a*), in which one can see the decrease of the profile offset P up to the slot end Z of the sheet slots 3.

Figure 1C:
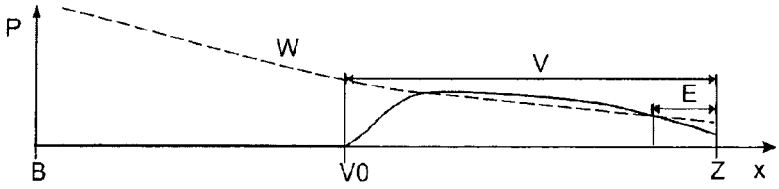

FIG. 1*c* shows qualitatively the course of the azimuthal profile offset P as a function of the position x along a sheet slot according to the invention. At the radially outside beginning B of the sheet slots, the latter have no azimuthal profile offset P. The stacking-wheel disks 11 and 12 have a mutual azimuthal profile offset P only in a staggered portion V. The staggered portion V of the sheet slot begins at the position x=V0 and extends up to the slot end x=Z of the sheet slot. The beginning V0 of the staggered portion V is removed from the beginning x=B of the sheet slot by at least 90% of the bank-note length in this example. In the portion V the azimuthal profile offset P varies along the sheet slot, decreasing toward the radially inside slot end Z. At the radially inside end of the staggered portion V there is an end portion E of the sheet slot in which only a small azimuthal profile offset P<W is present.

The change of the azimuthal profile offset P up to the slot end Z becomes clear from the sectional views A-A, B-B, C-C, D-D, which show the azimuthal profile offset P of the stacking-wheel disks 11 and 12 at four different positions x along the sheet slot 3. FIGS. 3*a-d* respectively show a sectional view through the sheet slots of the stacking wheel from FIG. 1*b* with a viewing direction contrary to the moving direction of the bank notes. The section A-A from FIG. 3*d* goes through the slot end Z of the sheet slot 3. The azimuthal profile offset amounts there to about half the sheet-slot width W present at the slot end Z. Since the azimuthal profile offset P at the slot end Z is considerably smaller than the width W of the sheet slot, the leading edge 2 of the bank note is not wavily deformed at this position, but extends straight in the direction transverse to the transport direction of the bank note, cf. FIG. 3*d*. The section B-B goes through the position x at which the azimuthal profile offset P is equal to the sheet-slot width W at this position, cf. FIG. 3*c*. At this position x, at which P=W holds, the end portion E also begins. The section C-C goes through a position x in the staggered portion V of the sheet slot, at which the azimuthal profile offset P amounts to about 1.2 times the sheet-slot width W at this position, cf. FIG. 3*b*. The section D-D goes through a position x in the staggered portion V of the sheet slot, at which the azimuthal profile offset P amounts to about 1.3 times the sheet-slot width W at this position x, cf. FIG. 3*a*. At the x positions of the sections B-B, C-C and D-D a wavy shape is imposed on the bank note transversely to the moving direction, cf. FIGS. 3*a*, 3*b* and 3*c*. Depending on the number of stacking-wheel disks 11, 12, a plurality of troughs and crests of waves can also be imposed on the bank notes there.

Figure 2B:
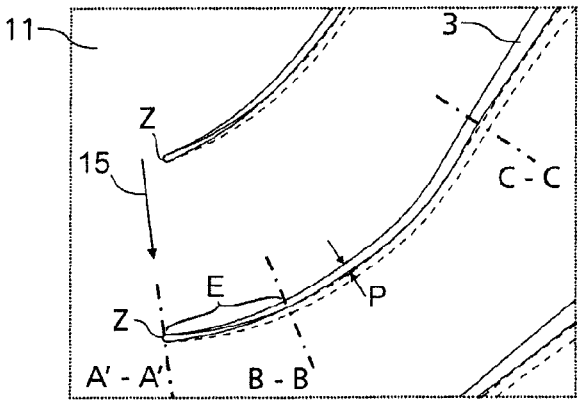
Figure 3A:
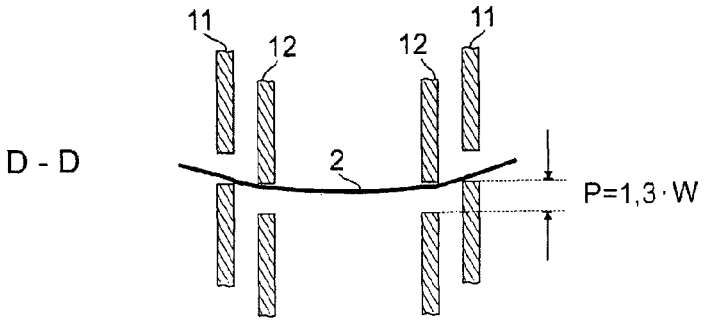
Figure 3B:
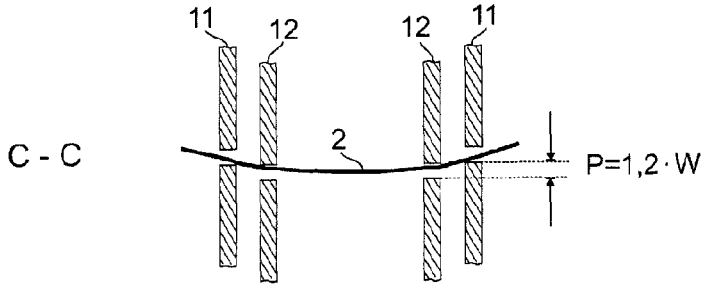
Figure 3C:
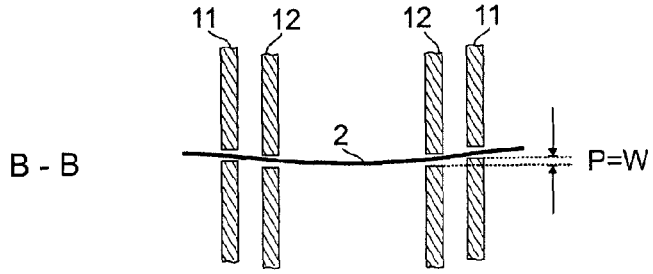
Figure 3D:
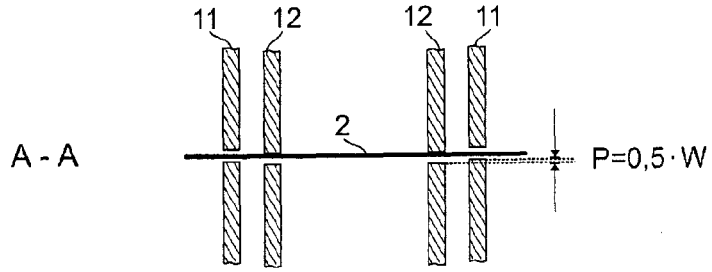
Figure 3E:
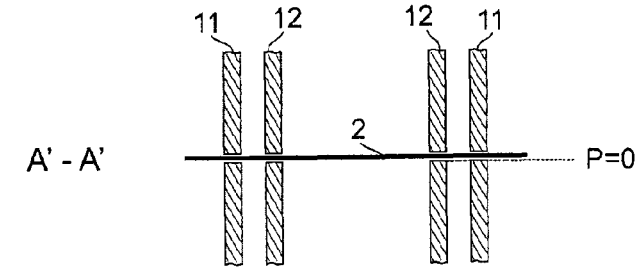

FIG. 2*b* shows an enlarged detail of the stacking wheel 10 of the second exemplary embodiment as represented in FIG. 2*a* (the detail being marked by dashed lines in FIG. 2*a*), in which one can see the decrease of the profile offset P at the radially inside end portion E of the sheet slots 3. The change of the azimuthal profile offset P up to the slot end Z becomes clear from the sectional views A'-A', B-B, C-C, which show the azimuthal profile offset P of the stacking-wheel disks 11 and 12 at three different positions x along the sheet slot 3. In contrast to the stacking wheel according to the first exemplary embodiment, the azimuthal profile offset P is completely eliminated in the second exemplary embodiment at the slot end Z, cf. section A'-A' in FIG. 2*b* and in FIG. 3*e*. The sheet slots of the first and second stacking-wheel disks 11, 12 are hence congruent at the slot end Z. Since the azimuthal profile offset P vanishes at the slot end Z, the leading edge 2 of the bank note is not wavily deformed at this position, but extends straight in the direction transverse to the transport direction of the bank note, cf. FIG. 3*e*. The sectional views B-B, C-C from FIGS. 3*b* and 3*c* also hold for the sections marked as B-B and C-C in FIG. 2*b*.

Alternatively to the exemplary embodiments shown, the stacking wheel according to the first exemplary embodiment can also have sheet slots with congruent slot ends Z. The stacking wheel according to the second exemplary embodiment can also alternatively have a small azimuthal profile offset at the slot end Z. The sheet-slot boundaries can also be configured so as to be spirally curved at the beginning B of the sheet slots 3, instead of straight.

Figure 4A:
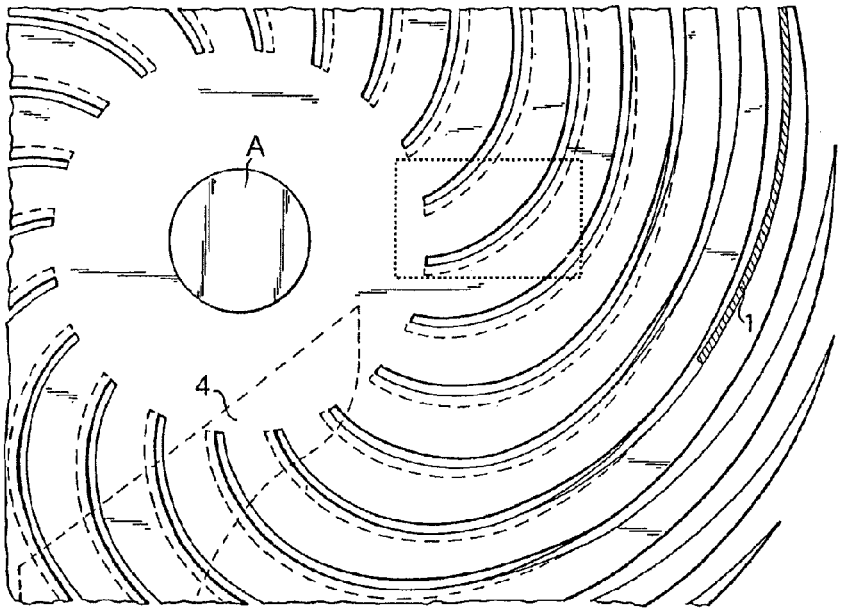
Figure 4B:
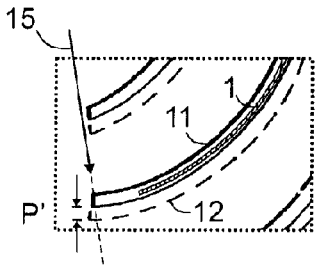
Figure 4C:
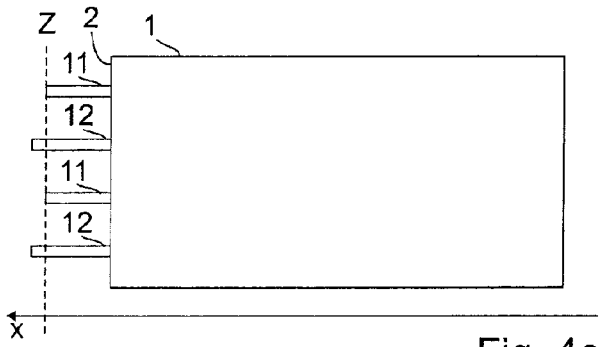

FIG. 4*a* represents a stacking wheel with staggering according to the prior art (cf. FIG. 2 of DE 3232348 A1). The stacking-wheel disks 11, 12 have an azimuthal profile offset P', cf. the detail from FIG. 4*a* as represented in FIG. 4*b*. The profile offset P' there remains constant and consistent up to the slot end Z. Viewed along the direction 15 extending perpendicularly to the transport direction of the bank notes at the slot end, there results the plan view, represented in FIG. 4*c*, of a bank note 1 that is moving toward the slot end Z. FIG. 4*c* shows the relative arrangement of the sheet slots for the four stacking-wheel disks of the stacking wheel from FIG. 4*a*. The sheet slots of the two stacking-wheel disks 11 are mutually offset along the moving direction of the bank note 1. Since the sheet slots of the stacking-wheel disks 11 end earlier along the moving direction of the bank note 1 than the sheet slots of the two stacking-wheel disks 12, the bank note 1 first, or solely, hits the two slot ends Z of the stacking-wheel disks 11. At the two impact points on the stacking-wheel disks 11 the bank note is decelerated to a standstill. At high transport speeds the bank notes are strongly damaged there.

Figure 4D:
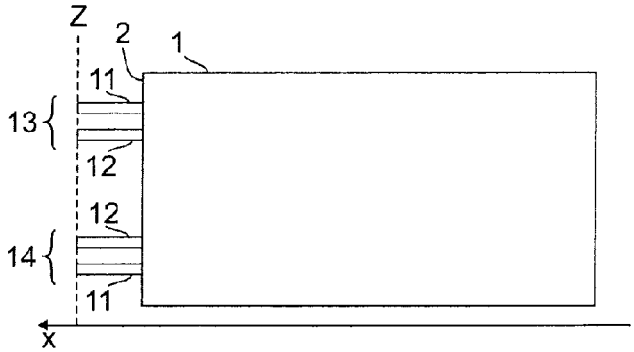

In contrast, the slot ends Z of the sheet slots 3 of the stacking-wheel disks 11 and 12 are preferably not mutually offset along the moving direction of the bank note in the stacking wheel 10 according to the invention, but end at the same position x, cf. FIG. 4*d*. The plan view of the bank note 1 as shown in FIG. 4*d* again results viewed along the direction 15 which extends perpendicularly to the moving direction of the bank notes at the slot end, cf. FIGS. 1*b* and 2*b*, The leading edge 2 of the bank note 1 hence hits the slot end Z of all four stacking-wheel disks 11, 12 simultaneously. Since the decelerating force is distributed uniformly over a plurality of impact points (in this example four), damage to the bank-note leading edge 2 is avoided even at high transport speeds.

In FIGS. 3*a-e* and FIG. 4*d* one can moreover see the arrangement of the stacking-wheel disks 11 and 12 along the axle A. A stacking-wheel disk 11 and a stacking-wheel disk 12 respectively form a disk pair 13 and a disk pair 14. The distance between the stacking-wheel disks 11 and 12 of the respective disk pair preferably amounts to at most 10 mm. In the portions with profile offset P the middle stacking-wheel disks 12 run ahead of the outer stacking-wheel disks 11.

The invention claimed is:

1. A stacking wheel for stacking sheets which has at least one first stacking-wheel disk and at least one second stacking-wheel disk which are disposed on an axle in a mutually concentric relationship and which are spaced apart in the axial direction and which respectively have distributed over their circumference a plurality of sheet slots for receiving a sheet which extend from radially outward to radially inward in a spiral shape within the respective stacking-wheel disk, wherein the sheet slots of the first and second stacking-wheel disks are disposed in a mutually staggered relationship in a portion of the sheet slots, wherein the sheet slots of the first and second stacking-wheel disks are disposed relative to each other such that an azimuthal profile offset that the sheet slots of the first and second stacking-wheel disks have relative to each other in the staggered portion is reduced or eliminated up to a slot end of the sheet slots, viewed along the sheet slots from radially outward to radially inward.

2. The stacking wheel according to claim 1, wherein when the sheets move radially inward within the sheet slots, the leading edges of the sheets are wavily deformed transversely to the moving direction of the sheets in the staggered portion and stretched again in an end portion of the sheet slots which lies at the radially inside slot end of the respective sheet slot.

3. The stacking wheel according to claim 1, wherein the sheet slots of the first and second stacking-wheel disks are disposed relative to each other in an end portion of the sheet slots such that the leading edge of the respective sheet forms substantially a straight line when hitting the radially inside slot end.

4. The stacking wheel according to claim 1, wherein the sheet slots of the first and second stacking-wheel disks are disposed relative to each other in an end portion of the sheet slots such that the leading edge of the respective sheet hits the radially inside slot ends of the sheet slots of the first stacking-wheel disk and of the second stacking-wheel disk simultaneously.

5. The stacking wheel according to claim 1, wherein the sheet slots of the first and second stacking-wheel disks have at the respective slot end no azimuthal profile offset or an azimuthal profile offset relative to each other that is smaller than the width of the sheet slots of the first and second stacking-wheel disks that the respective sheet slot has at the radially inside slot end.

6. The stacking wheel according to claim 1, wherein the sheet slots of the first and second stacking-wheel disks have at the respective slot end relative to each other at most an azimuthal profile offset that amounts to 80% of the slot width of the sheet slot at the radially inside slot end.

7. The stacking wheel according to claim 1, wherein the sheet slots of the first and second stacking-wheel disks are mutually congruent at their radially inside slot end.

8. The stacking wheel according to claim 1, wherein the sheet slots of the first and second stacking-wheel disks have, viewed along the sheet slots from radially outward to radially inward, as of a position of at least 5 mm before the radially inside slot end of the respective sheet slot of at least 10 mm, no or an azimuthal profile offset relative to each other that is smaller than the width of the sheet slots of the first and second stacking-wheel disks that the respective sheet slot has at the respective position.

9. The stacking wheel according to claim 1, wherein the sheet slots of the first and second stacking-wheel disks have at every position along the respective sheet slot no or at most an azimuthal profile offset relative to each other that amounts to 1.5 times the width of the first and of the second sheet slot that the respective sheet slot has at the respective position.

10. The stacking wheel according to claim 1, wherein the sheet slots of the stacking wheel extend wavily from radially outward to radially inward along the moving direction of the sheets.

11. The stacking wheel according to claim 1, wherein the sheet slots of the first and second stacking-wheel disks have a straight sheet-slot boundary, and in particular respectively have an opening angle of at least 25°, in a first portion of the sheet slots which lies at the outer end of the sheet slots of the first and second stacking-wheel disks, viewed from radially outward to radially inward.

12. The stacking wheel according to claim 1, wherein the stacking wheel has at least two disk pairs which are disposed on the axle in a mutually concentric relationship and are spaced apart in the axial direction, wherein each of the disk pairs is formed by one of the first and by one of the second stacking-wheel disks.

13. The stacking wheel according to claim 12, wherein the first and the second stacking-wheel disk of the respective disk pair are disposed along the axle at a distance apart of at most 15 mm.

14. The stacking wheel according to claim 1, wherein in the middle of the stacking wheel, viewed along the axle, there are disposed one or a plurality of second stacking-wheel disks whose sheet slots run ahead of the sheet slots of the first stacking-wheel disk in the staggered portion when the stacking wheel rotates around the axle for stacking the sheets, and that on both sides of the second stacking-wheel disks disposed in the middle there is respectively disposed at least one first stacking-wheel disk.

15. An apparatus for processing sheets, wherein the apparatus has at least one stacking wheel according to claim 1, the apparatus being in particular an apparatus for processing value documents.

* * * * *